US006761247B2

(12) United States Patent
Wyse

(10) Patent No.: US 6,761,247 B2
(45) Date of Patent: Jul. 13, 2004

(54) UTILITY SCAFFOLDING HAVING SAFETY FEATURES

(76) Inventor: Steven J. Wyse, 82 Pin Oak, Archbold, OH (US) 42502

( * ) Notice: Subject to any disclaimer, the term of this patent is extended or adjusted under 35 U.S.C. 154(b) by 0 days.

(21) Appl. No.: 10/065,251

(22) Filed: Sep. 27, 2002

(65) Prior Publication Data

US 2003/0010569 A1 Jan. 16, 2003

Related U.S. Application Data

(62) Division of application No. 09/766,334, filed on Jan. 19, 2001, now Pat. No. 6,471,003.

(51) Int. Cl.[7] ..... E04G 1/18

(52) U.S. Cl. ..... 182/118; 182/119; 182/222; 182/141

(58) Field of Search ..... 182/118, 115, 182/119, 141, 222; 292/4, 57, 60

(56) References Cited

U.S. PATENT DOCUMENTS 1,246,950 A * 11/1917 Sederstram ..... 292/60
2,403,065 A * 7/1946 Engert ..... 292/57
3,968,606 A * 7/1976 Facemire ..... 52/127.6
4,236,603 A * 12/1980 Talley ..... 182/204
5,069,309 A * 12/1991 Seiderski et al. ..... 182/119
6,471,003 B2 * 10/2002 Wyse ..... 182/119

* cited by examiner

*Primary Examiner*—Alvin Chin-Shue
(74) *Attorney, Agent, or Firm*—Hovey Williams LLP

(57) ABSTRACT

Scaffolding (10) having safety features for coupling scaffolding structural members so as to prevent equipment damage and worker injury from inadvertent disassembly, while permitting quick assembly and disassembly when desired. The scaffolding (10) incorporating the safety features broadly comprises legs (12); beams (14); a platform (16); coupling braces (18); platform pins (20); and platform clips (22). The first safety feature is a rounded, spring-biased, rotation-limited G-pin for adjustably coupling the beams (14) with the legs (12). The G-pin's rounded shape and a perpendicularly projecting stop (51) minimize risks of inadvertent removal. The second feature is a lockable pin (44) operable to independently couple structural members (12,14) in the event the G-pin is inadvertently removed. The third and fourth features are platform pins (20) and spring-biased platform clips (22) operable to prevent, respectively, undesirable horizontal and vertical movement of the platform (16).

18 Claims, 3 Drawing Sheets

UTILITY SCAFFOLDING HAVING SAFETY FEATURES

CROSS REFERENCE TO RELATED APPLICATIONS

This is a division of application Ser. No. 09/766,334 filed Jan. 19, 2001, now U.S. Pat. No. 6,471,003, which is hereby incorporated by reference herein.

BACKGROUND OF INVENTION

1. Field of the Invention

The present invention relates to scaffolding for providing an elevated work surface. More particularly, the invention relates to safety features for securing assembled scaffolding to prevent inadvertent disassembly and potentially resulting damage and injury.

2. Description of the Prior Art

Those ordinarily skilled in the art will appreciate that scaffolding is designed to be easily and quickly assembled where needed and disassembled for subsequent transport or storage. Unfortunately, in providing quickly connectable/disconnectable scaffolding assembly mechanisms, many existing scaffolding systems sacrifice safety and are prone to inadvertent and unsafe disassembly potentially resulting in damage or injury.

Such scaffolding is typically modular, with each module comprising four vertical legs, two horizontal beams, four coupling braces, and a work surface or platform, with the braces adjustably coupling the beams to the legs, and the work surface resting upon the beams.

Existing scaffolding systems typically use L-pins for coupling the braces with the legs. The legs and braces are each provided with a plurality of alignable first and second holes, respectively, through which the L-pins may be inserted. Platform height may be adjusted by removing the L-pins, repositioning the coupling braces to the desired height on the legs and replacing the L-pins in the corresponding aligned first and second holes. One disadvantage of the L-pin design is that it presents a projecting handle portion prone to catching on passing objects which can cause the L-pin to be inadvertently removed from the holes, thereby uncoupling the brace from the leg. This is particularly true where vibration in the scaffolding or other circumstances cause the L-pin to rotate so that its projecting handle portion extends outwardly in a manner especially suited to catch or snag upon passing objects.

Furthermore, the platforms are typically unsecured on the beams, relying only on contact with a beam lip to remain in place. Where platforms are warped or otherwise damaged, or are improperly placed upon the beams, they are prone to inadvertently slipping off the scaffolding.

Because existing scaffolding systems use assembly mechanisms that may result in inadvertent and unsafe disassembly of the scaffolding structure, a need exists for an improved system incorporating safety features to provide a more secure and reliable elevated work surface.

SUMMARY OF INVENTION

The present invention solves the above-described and other problems and provides a distinct advance in the art of safe scaffolding. More particularly, the present invention provides features which may be used in combination or independently to more safely and securely couple scaffolding members, including coupling the braces to the legs and the platform to the beams.

The first feature provides a round-handled, spring-biased, rotation-limited G-pin for adjustably coupling the legs to the braces. The G-pin is removably insertable into aligned first and second holes in, respectively, the leg and brace members, and includes a perpendicularly projecting stop, preferably a small roll pin, which prevents the G-pin from rotating outwardly and exposing itself to passing objects. The rounded shape of the G-pin's handle further minimizes potential snagging.

The second feature provides a lockable pin operable to support the coupling brace in the event the G-pin is inadvertently removed. The locking pin is insertable through a second pair of aligned first and second holes, parallel to the G-pin. The locking pin preferably extends completely through the brace and leg so as to provide a protruding portion adapted to receive a fastener.

The third and fourth features act to prevent inadvertent movement of the platform relative to the beams. The third feature provides platform pins welded or otherwise secured to the beams and rising upwardly therefrom to fit into pin holes drilled into the platform. Once the platform pins are received within the pin holes, the platform is prevented from shifting horizontally off of the beams. The fourth feature provides spring-biased C-clips operable to engage the beams and platform so as to prevent relative vertical movement therebetween and ensure that the platform will not inadvertently lift off the platform pins due, for example, to warping or vibration.

These novel features provide a safer and more reliable scaffolding structure than currently exists in the art, and are described in more detail in the section entitled DESCRIPTION OF A PREFERRED EMBODIMENT, below.

BRIEF DESCRIPTION OF DRAWINGS

A preferred embodiment of the present invention is described in detail below with reference to the attached drawing figures, wherein.

DETAILED DESCRIPTION

Figure 1:
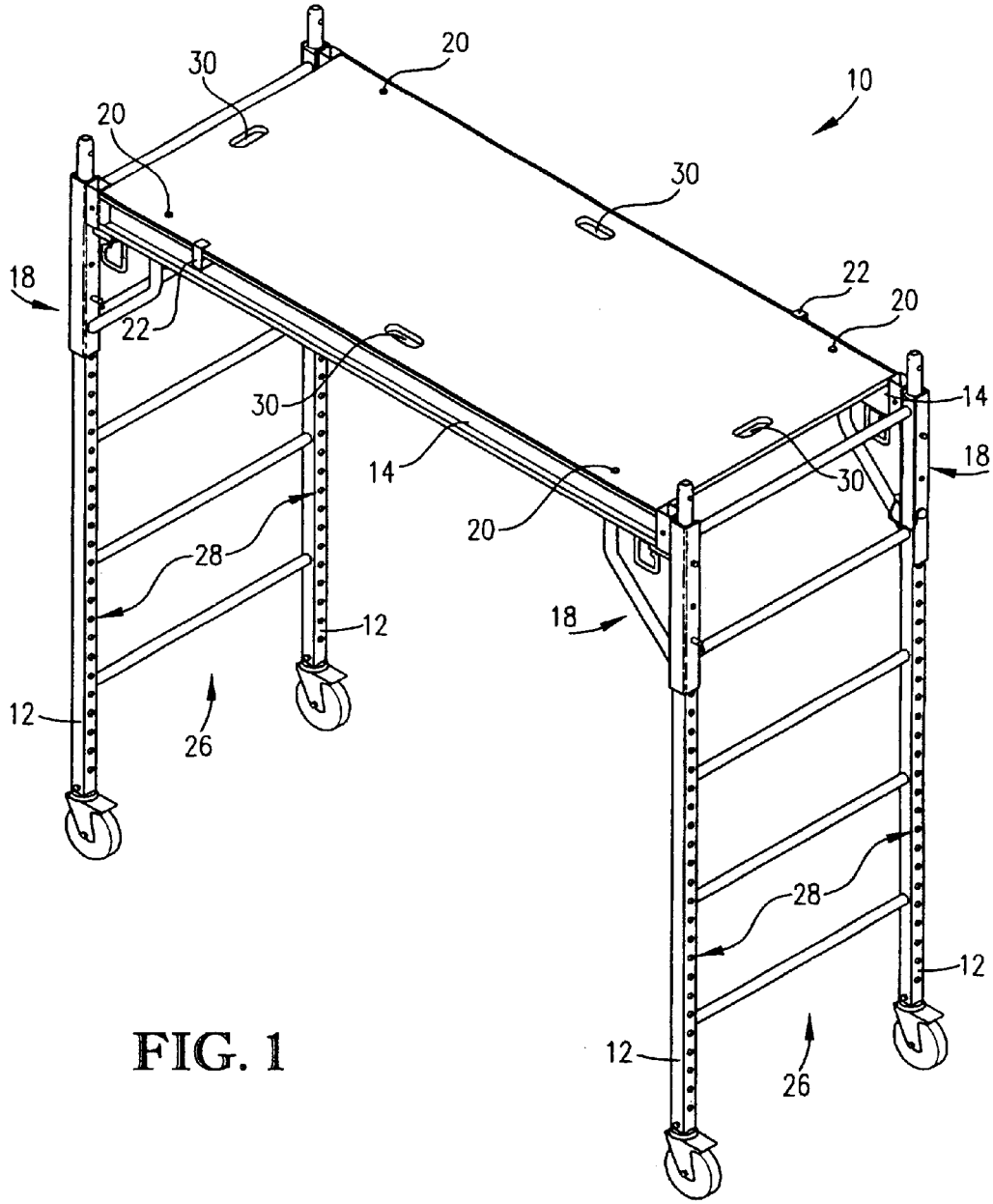
FIG. 1 is a perspective view of scaffolding incorporating preferred embodiments of the four safety features of the present invention.

Referring to FIG. 1, scaffolding 10 is shown operable to provide an elevated work surface for one or more workers. It should be noted that the present invention is for safety features for securely coupling scaffolding structural members so as to permit quick and easy assembly and disassembly thereof while preventing potential equipment damage and worker injury resulting from inadvertent disassembly. These safety features are independent of any particular scaffolding design, type, or brand, and are not limited to the particular scaffolding 10 shown for illustrative purposes only.

The scaffolding 10 broadly comprises four legs 12; two beams 14; a platform 16; four coupling braces 18; four platform pins 20; and two platform clips 22. The legs 12 are vertical support members for elevating the scaffolding structure. The legs 12 may vary in appearance and design but are preferably elongated hollow square or round tubes. A plurality of cross-bars 26 are welded between pairs of legs 12 to produce an end-frame unit of two fixedly-spaced legs and a ladder-like structure therebetween for allowing workers easier access to the elevated platform 16.

Each leg 12 includes a plurality of first holes 28 drilled therethrough at spaced intervals corresponding to the various possible heights to which the work platform 16 may be elevated. The number of such holes 28 is a matter of design choice. In a less preferred embodiment, only one or two holes are provided, in which case the work surface height is not adjustable.

The beams 14 are horizontal support members providing horizontal support for the scaffolding structure and, in particular, the platform 16. The beams 14 may vary in appearance and design but, when assembled, are supported by the coupling braces 18 to extend between the legs 12.

Figure 3:
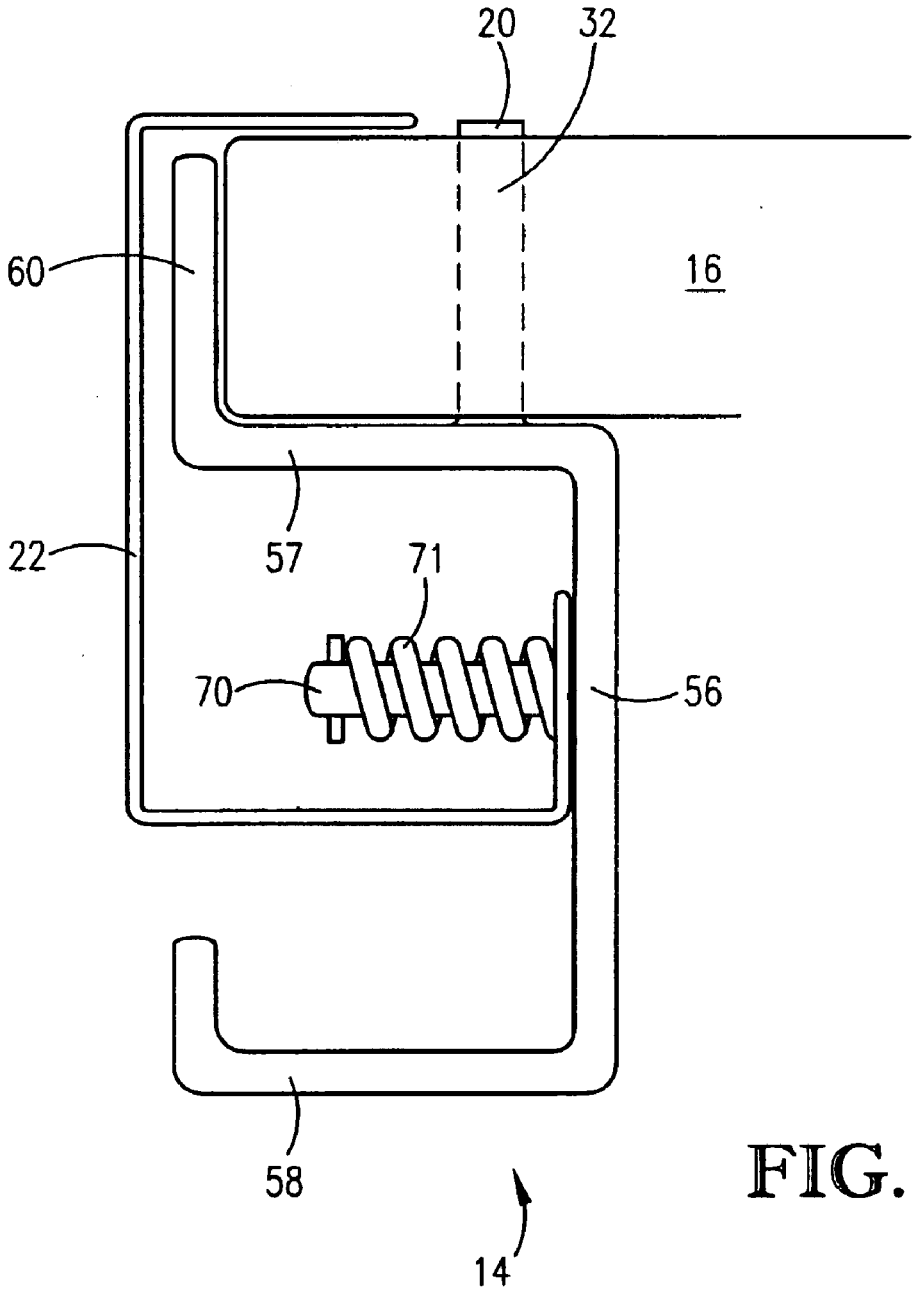
FIG. 3 is a sectional view of a portion of the scaffolding of FIG. 1 showing in detail preferred embodiments of a second two of the safety features of the present invention.

As is best shown in FIG. 3, the preferred beam 14 comprises a back 56; a top and bottom 57,58; and a lip 60. The back 56 is an elongated rectangular piece of material, preferably metal, having first and second long edges and first and second short edges. The top and bottom 57,58 extend perpendicularly outward from, respectively, the first and second long edges. The lip 60 extends perpendicularly from the top 57 and parallel to the back 56. The work surface 6 rests upon the top 57 of the beam 14, and abuts the lip 60 which helps to prevent undesired movement of the properly positioned platform 16.

Figure 2:
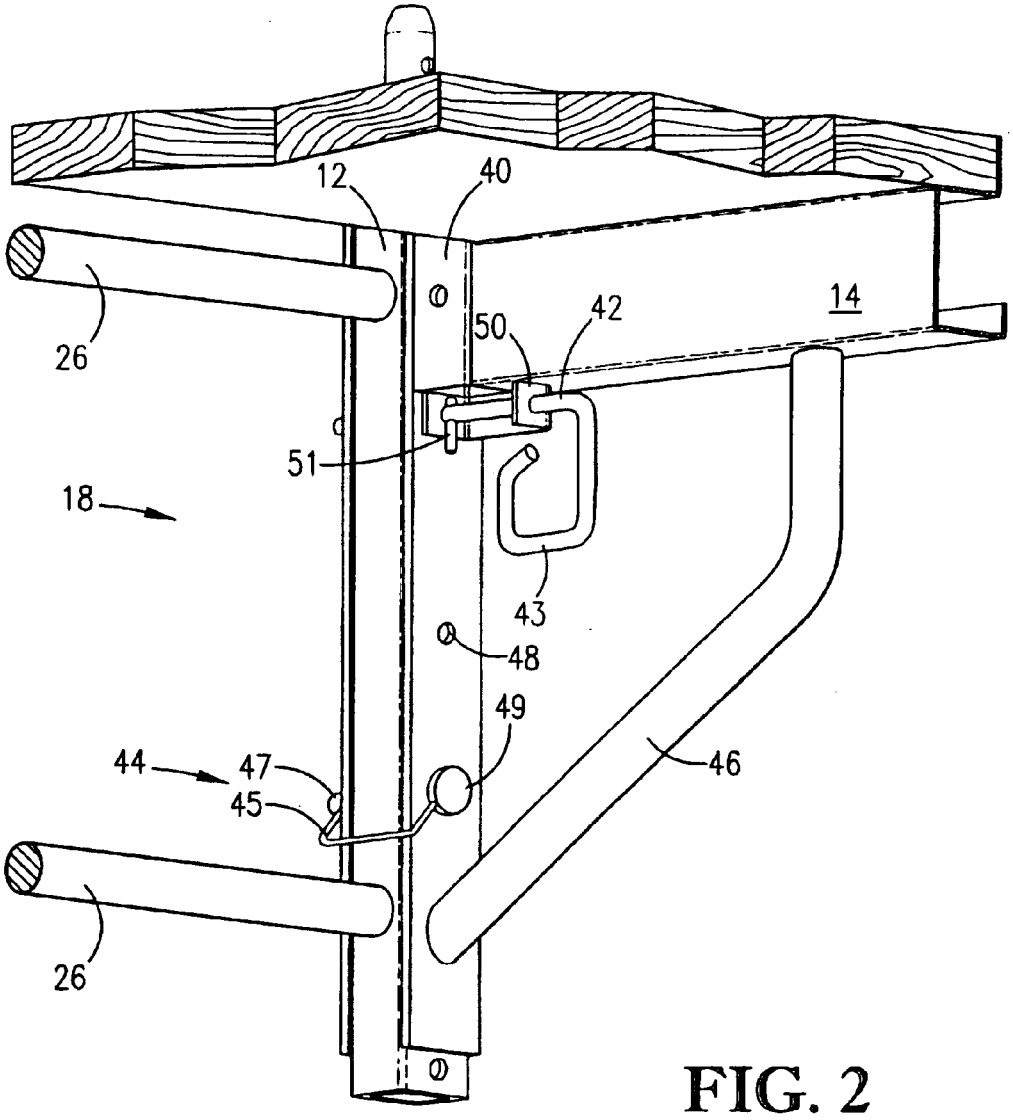
FIG. 2 is a fragmentary isometric view of a portion of the scaffolding of FIG. 1 showing in detail preferred embodiments of a first two of the safety features of the present invention.

Referring to FIGS. 1 and 2, the platform 16 provides a work surface operable, when supported by the beams 14 and elevated by the legs 12, to support one or more workers and their equipment. The platform 16 may vary in appearance and design but is preferably ⅝ inch plywood or other material of similar strength. The platform 16 preferably includes handholds 30 cut thereinto to allow for easier handling, and pin holes 32 drilled therethrough to accommodate the platform pins 20 as described below.

Referring to FIG. 2, the coupling braces 18 are shown operable to adjustably and securely couple the legs 12 with the beams 14 while permitting quick and easy assembly and disassembly thereof. Each coupling brace 18 comprises a sleeve 40; a G-pin 42; a locking pin 44; and a bracket 46.

A first portion of the sleeve 40 allows the brace 18 to be adjustably coupled with the leg 14. The sleeve 40 slidably fits over the leg 14 and presents at least two second holes 48 alignable with two of the first holes 28 in the leg 14. A second portion of the sleeve 40 is preferably welded or otherwise secured to the beam 14.

The G-pin 42 is operable to be retractably inserted through one of the second holes 48 and into or through one of the first holes 28, thereby securing the sleeve 40 to the leg 12. The G-pin 42 is preferably retained within and guided by a pin guide 50 projecting from the beam 14 and having at least one guide hole for receiving and slidably passing therethrough the G-pin 42. The G-pin 42 is preferably spring-biased by a spring (not shown) which must be actuated in order to position the sleeve 40 for insertion and removal of the G-pin 42 into and from the first holes 28.

The G-pin 42 includes a projecting handle portion 43 for gripping when inserting or removing the G-pin 42. Although the handle portion 43 is preferably rounded, being G- or O-shaped, it may be more generally said that the pin 42 preferably includes a handle portion 43 which first projects away from the pin's axis and then curves or bends back toward the axis in such a manner so as to be less likely to catch or snag upon passing objects.

To further minimize potential snagging, the G-pin 42 includes a perpendicularly projecting rollpin 51 or other projection being of a length and positioned so that, when the G-pin 42 is rotated outwardly, the rollpin 51 contacts a portion of the pin guide 50, beam 14, or leg 12 and prevents further rotation. Thus, the rollpin 51 restricts the G-pin 42 from rotating outwardly into a position whereby it would protrude beyond the leg and beam 12,14 and be more likely to snag passing objects.

As will be appreciated by those with skill in the art, in some applications it may be desirable to eliminate the G-shaped pin 42 of the present invention, retain the L-shaped or other pin conventionally used, and minimize snagging risks by severely limiting pin rotation using the rollpin 51 or a variation thereof. This is a generally less desirable embodiment because pin movement will be so restricted as to hamper efficient assembly and disassembly of the scaffolding. Nevertheless, it should be noted that the rollpin's anti-rotation function does not require a particular pin or pin shape.

The locking pin 44 is operable to independently couple the coupling brace 18 with the leg 12 in the event that the G-pin 42 is inadvertently withdrawn. The locking pin 44 removably inserts into aligned first and second holes 28,48 spaced apart from and parallel to the G-pin 42. Unlike the G-pin 42, the locking pin 44 is neither spring-biased nor rotationally limited, nor is it retained by a pin guide. Instead, the locking pin 44 preferably includes a first end 49 presenting a stop, and a second end 47 operable to receive a fastener 45. The nature of the fastener 45 is a matter of design choice, but may be a hexnut, wingnut, cotter pin, C-clip, or other suitable fastener. In a preferred embodiment, the locking pin 44 is of such a length that, when inserted through the first and second holes 28,28, the second end 47 protrudes beyond the leg 12 and sleeve 40 so that a wire yolk 45 may be attached to the first and second ends 43,47 of the inserted locking pin 44 thereby preventing the pin's inadvertent removal.

The bracket 46, is supportively secured at one end to the sleeve 40 and at another end to the beam 14, thereby providing additional structural support for the platform-supporting member 14.

Referring to FIG. 3, there are preferably four platform pins 20 per platform 16, the pins being welded or otherwise secured in an upright position to the beams 14. The platform pins 20 are received within the platform holes 32 when the platform 16 is properly placed upon the beams 14. The engaged relationship of the platform pins 20 and holes 32 restricts horizontal movement of the platform 16, thereby preventing it from inadvertently slipping off the beam 14.

The platform clips 22 may be applied once the platform 16 is properly placed upon the beams 14 and the platform pins 20 are received within the pin holes 32. A mounting pin 70 projects perpendicularly from the back 56 of the beam 14, and a lower leg portion of the platform clip 22 presents a hole through which the mounting pin 70 may be inserted. A spring 71 surrounding the mounting pin 70 biases the clip 22 against the back 56 of the beam 14. A top portion of the clip 22 is operable to slip over the lip 60 of the beam 14 to retractably engage the platform 16 and restrict vertical movement thereof. Thus, the platform clips 22 prevent the platform 16 from lifting off the platform pins 20, making them particularly desirable where work surfaces may warp due to moisture or bend under a load. When either of these situations occur, without the platform clips 22 the surface 16 might lift off of the platform pins 20 and over the lip 60 and slip off of the beams 14. Thus, the platform pins 20 and clips 22 operate together to prevent platform 16 movement.

In operation, to assemble the scaffolding 10, each G-pin 50 is retracted from its spring-biased position, the legs 12 are placed within the sleeves 40 of the coupling braces 18, and the first and second holes 28,28 aligned according to the desired platform height 16. The G-pins 42 may then be released so that they pass through the second holes 48 and into the first holes, thereby securely coupling the sleeves 40 with the legs 12. The locking pins 44 may thereafter be inserted into first and second holes parallel to the G-pins, and secured with the fasteners 45.

The platform 16 is then positioned so that the platform pins 20 of the beams 14 are received within the pin holes 32 of the platform 16. The platform clips 22 are pulled away from the back 56 of the beam 14 until the upper portion of the clip 22 can be rotated over the lip 60 and platform 16. The platform clip 22 is then released to return to its spring-biased position, thereby securely engaging the platform 16 and holding it firmly upon the beam 14.

Disassembly of the scaffolding 10 is accomplished by performing the preceding described steps in reverse order.

Although the invention has been described with reference to the preferred embodiment illustrated in the attached drawing figures, it is noted that equivalents may be employed and substitutions made herein without departing from the scope of the invention as recited in the claims. In particular, the present invention is for safety features for securely and safely coupling scaffolding structural members, and is independent of any particular scaffolding design, type, or brand.

What is claimed is:

1. Scaffolding for providing an elevated work surface, the scaffolding comprising:

a platform defining the work surface and having a pin hole;

a vertical support member including a plurality of spaced apart first holes;

a horizontal support member for supporting the platform;

a coupling mechanism slidably received on the vertical support member and fixed relative to the horizontal support member to couple the vertical support member with the horizontal support member, the coupling mechanism including at least two spaced apart second holes, with each of the second holes being simultaneously alignable with a respective one of the first holes to result in a first and second pair of aligned holes;

a first pin including a straight portion insertable into the first pair of aligned holes, and a handle portion projecting first away from and then back towards the straight portion, said handle portion being rotatable relative to the coupling mechanism when the straight portion is inserted into the first pair of aligned holes;

a rotation-limiting mechanism associated with the first pin and operable to limit the ability of the inserted first pin to rotate;

a locking pin insertable into the second pair of aligned holes when the straight portion is inserted into the first pair of aligned holes, the locking pin having a locking mechanism for preventing inadvertent removal of the locking pin when the locking pin is inserted into the second pair of aligned holes, said locking pin being removable from the second pair of aligned holes without removing the straight portion from the first pair of aligned holes;

a platform pin projecting uprightly from the horizontal support member and operable to be received within the pin hole and thereby restrict horizontal movement of the platform relative to the horizontal support member; and a platform clip operable to simultaneously engage both the platform and the horizontal support member and to thereby restrict vertical movement of the platform relative to the horizontal support member, said platform clip being rotatable into and out of an engaged position wherein vertical movement of the platform relative to the support member is restricted.

2. The scaffolding as set forth in claim 1, the handle portion of the first pin being substantially G-shaped.

3. The scaffolding as set forth in claim 1, the rotation-limiting mechanism being a projection transversely coupled with the first pin and operable when the first pin is rotated to contact an adjacent portion of the scaffolding, rotation of the first pin being thereby limited to the spatial relationship between the rotation-limiting mechanism and the adjacent portion of the scaffolding.

4. The scaffolding as set forth in claim 1, the locking mechanism of the locking pin being selected from the group consisting of: wingnuts, hex nuts, C-clips, wire clips, wire yolks.

5. The scaffolding as set forth in claim 1, the platform clip being coupled with the horizontal support member so as to be spring-biased when in the engaged position.

6. The scaffolding as set forth in claim 1, said horizontal support member being vertically adjustable relative to the vertical support member.

7. The scaffolding as set forth in claim 6, said plurality of first holes being vertically spaced apart from one another, each of said first holes being associated with the horizontal support member being in a corresponding vertical adjustment relative to the vertical support member so that when the first pin is inserted into the first pair of aligned holes the horizontal support member is retained in the corresponding vertical adjustment.

8. Scaffolding comprising:

a support leg including at least a first and a second aperture formed therein;

a beam couplable to the leg so that when coupled thereto the beam is supported by the leg and operable to support a worker elevated from the ground;

a first coupling mechanism removably coupling the beam to the leg, said first coupling mechanism including a first and a second pin each being independently shiftable relative to the beam between an insert position wherein the respective pin engages one of the apertures and a retracted position wherein the respective pin is disengaged from the apertures, said beam being movable relative to the leg when the first and second pins are both in the retracted position and prevented from moving relative to the leg if either pin is in the insert position;

a platform couplable to the beam and defining a work surface and including at least one dowel-receiving hole; and a second coupling mechanism removably coupling the platform to the beam, said second coupling mechanism including a dowel and a peg each projecting from the beam and a platform clip shiftably coupled to the peg, said dowel being received in the dowel-receiving hole to thereby restrict movement of the platform relative to the beam in a first direction, said platform clip shiftable into and out of an engaged position wherein movement of the platform relative to the beam in a second direction is prevented, said first and second directions being generally perpendicular.

9. The scaffolding as claimed in claim 8, said dowel projecting from the beam in the second direction.

10. The scaffolding as claimed in claim 9, said peg projecting from the beam in the first direction.

11. The scaffolding as claimed in claim 8, said platform clip being rotatable about the peg when out of the engaged position and generally prevented from rotating about the peg when in the engaged position.

12. The scaffolding as claimed in claim 11, said platform clip being generally C-shaped.

13. The scaffolding as claimed in claim 11, said platform clip being yieldably biased into the engaged position.

14. The scaffolding as claimed in claim 8, each pin being independently rotatable when in the insert position.

15. The scaffolding as claimed in claim 8, said first pin engaging the first aperture when in the insert position and said second pin engaging the second aperture when in the insert position.

16. The scaffolding as claimed in claim 15, said first pin including a handle.

17. The scaffolding as claimed in claim 16, said handle being substantially G-shaped.

18. The scaffolding as claimed in claim 15, said second pin including a locking mechanism movable into and out of a locked position wherein the second pin is prevented from shifting out of the insert position.

* * * * *